United States Patent [19]

Hoshino et al.

[11] Patent Number: 4,975,242

[45] Date of Patent: Dec. 4, 1990

[54] CARBON STEEL FOR MACHINE STRUCTURAL USE

[75] Inventors: Toshiyuki Hoshino; Nobuhisa Tabata, both of Chiba; Isao Machida, Wako; Masayoshi Saga, Wako; Takeshi Takagi, Wako, all of Japan

[73] Assignees: Honda Gikan Kogyo Kabushiki Kaisha; Kawasaki Steel Corp., both of Tokyo, Japan

[21] Appl. No.: 441,885

[22] Filed: Nov. 27, 1989

[30] Foreign Application Priority Data

Nov. 29, 1988 [JP] Japan ..... 63-299721

[51] Int. Cl.[5] ..... C22C 38/04

[52] U.S. Cl. ..... 420/104; 420/105; 420/128; 420/123

[58] Field of Search ..... 420/104, 105, 128, 8, 420/123; 148/333, 334

[56] References Cited

FOREIGN PATENT DOCUMENTS 57-98657 6/1982 Japan ..... 420/104
61-113744 5/1986 Japan ..... 420/104

*Primary Examiner*—Deborah Yee
*Attorney, Agent, or Firm*—Austin R. Miller

[57] ABSTRACT

A carbon steel useful for machine structural use having improved cold forgability and induction hardenability comprises particular amounts of C, Si, Mn, Cr, S, P, O, N or further Mo and the balance being substantially Fe.

2 Claims, No Drawings

CARBON STEEL FOR MACHINE STRUCTURAL USE

BACKGROUND OF THE INVENTION

1. Field of the Invention

This invention relates to carbon steels for machine structural use, and more particularly to a carbon steel for machine structural use having low deformation resistance in cold forging and having excellent induction hardenability.

2. Related Art Statement

The cold forging is a plastic working method applied over a wide range of from bolt and nut to large-size automobile parts because it has advantages that the finish dimensional accuracy and the yield of material to be forged are excellent and the number of finish cutting steps after the forging becomes less.

Heretofore, steel materials containing less than 0.40% by weight (hereinafter reported simply as %) of C have frequently been used in cold forging. This is because steel materials containing not less than 0.40% of C were high in the deformation resistance during cold forging and were deficient in deformability durable to severe working.

However, has cold forging has recently been applied to steel materials containing not less than 0.40% of C in response to demand for increasing the strength of mechanical parts, particularly surface hardness after quench tempering. In case of using such steel materials, since the increase of deformation resistance is not avoided as previously mentioned, not only the life of the working tool considerably lowers, but also the deformation loading is higher than the capacity of the forging machine and it is required to replace the forging machine with a larger size forging machine.

On the other hand, the reduction of deformation resistance can usually be attained by decreasing the amounts of alloying elements to be added, but the decrease of amounts of alloying elements inversely brings about the degradation of hardenability, so that it was necessary to sacrifice either one of such conflicting properties.

In this connection, various countermeasures for solving the above problems have been proposed from time.

For instance, Cr added steel and Cr-B added steel for reducing deformation resistance without damaging hardenability are disclosed in the Report of Plastic Working Spring Meeting in the year of 1987 (1987. 5. 15~17, pp 301-302). Since these steels contain not less than 0.41% of Cr, however, the deformation resistance is still high as mentioned later.

Furthermore, the reduction of deformation resistance and the increase of deformability have been attempted by restricting the amounts of Si, Mn, Cr or further S, P, N, O in Japanese Patent Laid open No. 59-159771 and No. 61-113744. In these techniques, however, the hardenability, particularly induction hardenability, was is still poor, though a reduction of deformation resistance was attained.

SUMMARY OF THE INVENTION

It is, therefore, an object of the invention to advantageously solve the aforementioned problems and to provide a carbon steel for machine structural use having low deformation resistance in cold forging and having excellent induction hardenability.

Since the steel material of this type is high in deformation resistance in a ferrite/pearlite structure, it is subjected to spheroidizing, cold forging, induction hardening and tempering in this order.

The inventors have made studies with respect to the influence of each alloying element upon the deformation resistance and induction hardenability in the spheroidized state and have found the following facts.

At first, it has been found that the influence of the alloying element upon the deformation resistance in the spheroidized state becomes large in the order of C, Mo, Cr, Si and Mn. Furthermore, it is considered that such a strengthening action of these elements can be divided into the reinforcement of the ferrite matrix and the refinement of cementite. The element predominating in the former case is Si, while the element predominating in the latter case is Cr. Moreover, C increases the amount of cementite to increase the deformation resistance. And also, Mn and Mo take part in both the reinforcement of solid solution into the ferrite matrix and the refinement of the cementite.

Next, the influence of each alloying element upon induction hardenability in the spheroidized state is as follows:

The surface hardness is substantially determined by the C content. On the other hand, when the amount of the alloying element added is same, the effective hardened depth increases in the order of C>Mo>Mn>Si, while Cr reduces the effective hardened depth. This is because, Cr is an element which in remarkably concentrated in cementite, so that the cementite is stabilized by such a concentration. Also, hardly soluble Cr carbide is formed, and consequently the resulting carbide is not dissolved by heating in a short time such as in induction heating.

This invention is based on the above knowledge and has created a carbon steel for machine structural use having improved cold forgeability and induction hardenability, consisting essentially of 0.40-0.60 wt% of C, not more than 0.05 wt% of Si, 0.30-0.75 wt% of Mn, not more than 0.15 wt% of Cr, 0.005-0.020 wt% of S, not more than 0.015 wt% of P, not more than 0.0020 wt% of 0, not more than 0.0080 wt% of N and the balance being substantially Fe or further containing 0.05-0.30 wt% of Mo.

DESCRIPTION OF THE PREFERRED EMBODIMENTS

According to the invention, the reason why the composition of the components is limited to the above range will be described in detail below.

C: Carbon is an element useful for ensuring surface hardness in induction heating and effective hardened depth, and is positively added. When the amount of carbon is less than 0.40%, it is difficult to ensure the strength required for mechanical parts, while when the percentage C exceeds 0.60%, the deformation resistance becomes too large in the cold forging and the given low deformation loading is not obtained. Therefore, the amount of carbon added is limited to a range of 0.40-0.60%.

Si: Silicon increases deformation resistance in cold forging next to C, Mo, Cr, and is small in its effect on improving the effective hardened depth in induction hardening, so that the amount of Si added is preferably reduced a far as possible. Moreover, the upper limit is accepted to be 0.05%.

Mn: Manganese is positively added because it increases the effective hardened depth. When the amount of Mn is less than 0.30%, the addition effect is poor, while when it exceeds 0.75%, the deformation resistance increases and the given low deformation loading is not obtained. Therefore, the Mn amount is restricted to a range of 0.30–0.75%.

Cr: Chromium increases the deformation resistance in the spheroidized state next to C, Mo, and also acts to reduce the effective hardened depth in induction hardening. Regarding this point, Cr is a harmful element. However, it acts to improve the deformability in the cold forging. Therefore, the Cr amount is limited to 0.15% as an upper limit.

S: Sulfur lowers deformability in cold forging, but is useful for improvement of machinability. Therefore, S is positively added within a range of 0.005–0.020% from a viewpoint of even balance between deformability and machinability.

P: Phosphorus hardens the ferrite matrix in the spheroidized state to increase deformation resistance and considerably degrades the deformability, so that it is desirable to reduce phosphorus as far as possible. On this point, the P amount is accepted to be not more than 0.015%.

O: Oxygen increases non-metallic inclusion of oxide to lower deformability in the cold forging, so that it is desirable to reduce the amount as far as possible. Therefore, the O amount is not more than 0.0020%.

N: Nitrogen produces dynamic strain aging in cold forging to bring about an increase of deformation resistance and degradation of workability. Therefore, the N amount should be reduced as far as possible and is not more than 0.0080%.

Mo: Molybdenum is an element useful for increasing the effective hardened depth at a slight addition amount and can reduce deformation resistance without degrading hardenability. However, it is a very expensive element, so that it is only added if necessary. The amount is at least 0.05%, but when it exceeds 0.30%, an increase of deformation resistance is caused, so that the Mo amount is within a range of 0.05–0.30%.

According to the invention, the reason why the deformation resistance can be reduced in cold forging without degrading induction hardenability is based on the following facts:

In general, Mn, Cr and Mo are known as elements for improving hardenability. However, the inventors have newly found that the effect of improving the hardenability in the spheroidized state is greatest in Mo and is greater in Mn but that Cr inversely degrades the hardenability.

That is, it has been found that Mn and Cr are concentrated in cementite in the spheroidized state, and in this case the concentration degree is larger in Cr than in Mn, while Mo is not concentrated in cementite when used in the amount defined in the invention.

These elements are necessary to be uniformly solute into austenite for effectively developing hardenability. In the case of heating in a short time such as induction heating, however, the dissolution of cementite and the uniformization of alloying elements are not sufficiently achieved. As a result, the elements not remaining in the cementite but uniformly remaining in the ferrite matrix in the spheroidized state substantially contribute to hardenability. Therefore, when the added amount is the same, the contribution to hardenability becomes large in the order of Mo and Mn.

In this connection, Cr remarkably concentrates in the cementite and forms a hardly soluble carbide, so that hardenability is rather degraded by the addition of Cr.

The inventors have made investigations based on the technical idea that Mn and Mo, which produce a high hardening effect are selectively utilized and Si and Cr which make a small contribution to hardenability and increase of deformation resistance are reduced in amount based upon the above knowledge, and as a result the invention has been accomplished. Thus, according to the invention, the deformation resistance can be reduced in cold forging without degrading induction hardenability.

The following examples are given in illustration of the invention and are not intended as limitations thereof.

A steel bar having a chemical composition as shown in the following Table 1 and a diameter of 52 mm was manufactured through melting step in converter-continuous casting step - rolling step for bar. Then, the steel bar was subjected to spheroidizing, which was subjected to a cold forging test and an induction hardening test.

The cold forging test was carried out according to a method proposed by A Cold Forging Sectional Meeting of The Japanese Plastic Working Society (Plastic and Working, vol. 22, No. 241, 1981) after a columnar specimen of 15 mm (diameter)×22.5 mm (height) was prepared from the test steel by cutting, whereby the limiting compressibility and deformation resistance were measured.

The induction hardening test was carried out by preparing a test specimen of 30 mm (diameter)×150 mm (length) from the test steel and subjecting it to an induction hardening in the usual manner and tempering in an electric furnace at 150° C. for 30 minutes. Thereafter, the hardness distribution in the section of the specimen was measured, wherein the depth of Hv≧392 was defined as an effective hardened depth.

These test results are also shown in Table 1. Moreover, the deformation resistance was represented by the value when the compressibility was 70%.

TABLE 1

| Test steel | Chemical composition (%) | | | | | | | | | Induction hardening | | Cold forging | | |
|---|---|---|---|---|---|---|---|---|---|---|---|---|---|---|
| | | | | | | | | | | surface hardness | effective hardened depth | limiting compressibility | deformation resistance | |
| No. | C | Si | Mn | P | S | Cr | Mo | O | N | ($H_RC$) | (mm) | (%) | (kgf/mm$^2$) | Remarks |
| 1 | 0.40 | 0.22 | 0.75 | 0.015 | 0.014 | 0.18 | — | 0.0015 | 0.0045 | 53.0 | 2.03 | 68.4 | 82.8 | comparative example |
| 2 | 0.45 | 0.22 | 0.76 | 0.013 | 0.012 | 0.17 | — | 0.0014 | 0.0049 | 56.5 | 2.16 | 66.3 | 85.1 | comparative example |
| 3 | 0.48 | 0.22 | 0.75 | 0.015 | 0.012 | 0.19 | — | 0.0015 | 0.0046 | 57.1 | 2.25 | 65.4 | 86.4 | comparative example |
| 4 | 0.50 | 0.20 | 0.74 | 0.013 | 0.014 | 0.18 | — | 0.0013 | 0.0045 | 58.0 | 2.30 | 65.0 | 86.5 | comparative |

TABLE 1-continued

| Test steel No. | Chemical composition (%) C | Si | Mn | P | S | Cr | Mo | O | N | Induction hardening surface hardness ($H_RC$) | effective hardened depth (mm) | Cold forging limiting compress-ibility (%) | deformation resistance (kgf/mm$^2$) | Remarks |
|---|---|---|---|---|---|---|---|---|---|---|---|---|---|---|
| 5 | 0.53 | 0.19 | 0.73 | 0.014 | 0.013 | 0.19 | — | 0.0019 | 0.0040 | 58.5 | 2.38 | 64.9 | 87.4 | comparative example |
| 6 | 0.55 | 0.21 | 0.72 | 0.015 | 0.015 | 0.18 | — | 0.0016 | 0.0035 | 59.4 | 2.43 | 64.2 | 88.2 | comparative example |
| 7 | 0.58 | 0.22 | 0.76 | 0.010 | 0.014 | 0.19 | — | 0.0019 | 0.0045 | 61.1 | 2.58 | 63.9 | 90.0 | comparative example |
| 8 | 0.60 | 0.21 | 0.75 | 0.011 | 0.014 | 0.18 | — | 0.0018 | 0.0049 | 62.1 | 2.61 | 63.0 | 90.6 | comparative example |
| 9 | 0.40 | 0.01 | 0.65 | 0.004 | 0.014 | 0.03 | — | 0.0019 | 0.0045 | 53.0 | 2.10 | 70.0 | 75.9 | acceptable example |
| 10 | 0.45 | 0.02 | 0.68 | 0.004 | 0.019 | 0.03 | — | 0.0018 | 0.0045 | 56.5 | 2.18 | 68.4 | 78.5 | acceptable example |
| 11 | 0.48 | 0.03 | 0.68 | 0.004 | 0.014 | 0.04 | — | 0.0019 | 0.0043 | 57.1 | 2.25 | 67.2 | 80.3 | acceptable example |
| 12 | 0.50 | 0.02 | 0.65 | 0.003 | 0.013 | 0.02 | — | 0.0017 | 0.0039 | 58.0 | 2.33 | 66.4 | 80.4 | acceptable example |
| 13 | 0.53 | 0.01 | 0.64 | 0.002 | 0.013 | 0.01 | — | 0.0015 | 0.0042 | 58.5 | 2.41 | 65.8 | 81.1 | acceptable example |
| 14 | 0.55 | 0.01 | 0.65 | 0.004 | 0.010 | 0.03 | — | 0.0013 | 0.0046 | 59.4 | 2.50 | 65.5 | 82.3 | acceptable example |
| 15 | 0.58 | 0.02 | 0.63 | 0.003 | 0.017 | 0.06 | — | 0.0019 | 0.0047 | 61.1 | 2.61 | 64.8 | 83.8 | acceptable example |
| 16 | 0.60 | 0.03 | 0.64 | 0.003 | 0.014 | 0.05 | — | 0.0018 | 0.0045 | 62.1 | 2.64 | 64.5 | 84.3 | acceptable example |
| 17 | 0.48 | 0.02 | 0.65 | 0.010 | 0.012 | 0.25 | — | 0.0012 | 0.0043 | 57.2 | 2.08 | 65.4 | 83.5 | comparative example |
| 18 | 0.48 | 0.02 | 0.66 | 0.011 | 0.009 | 0.42 | — | 0.0014 | 0.0042 | 57.5 | 2.04 | 65.0 | 84.7 | comparative example |
| 19 | 0.48 | 0.03 | 0.67 | 0.009 | 0.010 | 0.63 | — | 0.0013 | 0.0044 | 57.1 | 1.98 | 65.3 | 87.2 | comparative example |
| 20 | 0.48 | 0.02 | 0.66 | 0.012 | 0.013 | 0.76 | — | 0.0016 | 0.0045 | 56.9 | 1.93 | 65.1 | 89.0 | comparative example |
| 21 | 0.40 | 0.03 | 0.57 | 0.006 | 0.012 | 0.07 | 0.10 | 0.0011 | 0.0038 | 53.4 | 2.00 | 70.0 | 75.3 | acceptable example |
| 22 | 0.45 | 0.02 | 0.57 | 0.010 | 0.010 | 0.08 | 0.12 | 0.0016 | 0.0040 | 56.7 | 2.19 | 68.2 | 77.3 | acceptable example |
| 23 | 0.48 | 0.04 | 0.57 | 0.008 | 0.009 | 0.09 | 0.13 | 0.0015 | 0.0044 | 57.2 | 2.27 | 67.4 | 78.3 | acceptable example |
| 24 | 0.50 | 0.03 | 0.56 | 0.009 | 0.008 | 0.06 | 0.12 | 0.0012 | 0.0042 | 58.3 | 2.32 | 66.8 | 79.1 | acceptable example |
| 25 | 0.53 | 0.02 | 0.57 | 0.007 | 0.011 | 0.05 | 0.11 | 0.0012 | 0.0044 | 58.7 | 2.40 | 66.0 | 79.2 | acceptable example |
| 26 | 0.55 | 0.03 | 0.55 | 0.008 | 0.012 | 0.06 | 0.11 | 0.0015 | 0.0046 | 60.0 | 2.46 | 65.7 | 81.1 | acceptable example |
| 27 | 0.58 | 0.04 | 0.57 | 0.010 | 0.011 | 0.06 | 0.12 | 0.0014 | 0.0038 | 61.4 | 2.59 | 65.0 | 82.7 | acceptable example |
| 28 | 0.60 | 0.03 | 0.57 | 0.009 | 0.010 | 0.09 | 0.12 | 0.0016 | 0.0049 | 62.5 | 2.63 | 64.5 | 83.7 | acceptable example |
| 29 | 0.40 | 0.02 | 0.45 | 0.010 | 0.012 | 0.07 | 0.18 | 0.0017 | 0.0046 | 53.0 | 2.01 | 70.0 | 73.2 | acceptable example |
| 30 | 0.45 | 0.02 | 0.44 | 0.008 | 0.009 | 0.09 | 0.19 | 0.0018 | 0.0045 | 56.5 | 2.18 | 69.5 | 75.3 | acceptable example |
| 31 | 0.48 | 0.03 | 0.46 | 0.011 | 0.011 | 0.10 | 0.17 | 0.0019 | 0.0044 | 57.1 | 2.27 | 68.3 | 77.2 | acceptable example |
| 32 | 0.50 | 0.04 | 0.45 | 0.010 | 0.008 | 0.11 | 0.20 | 0.0017 | 0.0039 | 58.0 | 2.34 | 66.7 | 78.1 | acceptable example |
| 33 | 0.53 | 0.03 | 0.46 | 0.010 | 0.011 | 0.10 | 0.21 | 0.0016 | 0.0044 | 58.5 | 2.44 | 66.9 | 78.9 | acceptable example |
| 34 | 0.55 | 0.03 | 0.45 | 0.009 | 0.010 | 0.06 | 0.18 | 0.0012 | 0.0039 | 59.4 | 2.50 | 65.8 | 79.7 | acceptable example |
| 35 | 0.58 | 0.01 | 0.46 | 0.011 | 0.013 | 0.09 | 0.22 | 0.0013 | 0.0044 | 61.2 | 2.61 | 65.0 | 80.5 | acceptable example |
| 36 | 0.60 | 0.02 | 0.46 | 0.011 | 0.020 | 0.10 | 0.19 | 0.0012 | 0.0038 | 62.2 | 2.63 | 64.9 | 81.9 | acceptable example |
| 37 | 0.40 | 0.03 | 0.35 | 0.008 | 0.006 | 0.07 | 0.25 | 0.0014 | 0.0039 | 53.4 | 2.05 | 70.2 | 71.7 | acceptable example |
| 38 | 0.45 | 0.02 | 0.33 | 0.010 | 0.018 | 0.06 | 0.26 | 0.0016 | 0.0045 | 56.7 | 2.19 | 69.8 | 73.3 | acceptable example |
| 39 | 0.48 | 0.01 | 0.32 | 0.011 | 0.012 | 0.09 | 0.27 | 0.0011 | 0.0042 | 57.2 | 2.28 | 68.2 | 74.3 | acceptable example |
| 40 | 0.50 | 0.03 | 0.35 | 0.010 | 0.009 | 0.07 | 0.28 | 0.0015 | 0.0043 | 58.3 | 2.39 | 67.4 | 75.6 | acceptable example |
| 41 | 0.53 | 0.04 | 0.36 | 0.011 | 0.008 | 0.09 | 0.27 | 0.0016 | 0.0042 | 58.7 | 2.47 | 66.1 | 77.5 | acceptable example |

TABLE 1-continued

| Test steel No. | Chemical composition (%) C | Si | Mn | P | S | Cr | Mo | O | N | Induction hardening surface hardness ($H_RC$) | effective hardened depth (mm) | Cold forging limiting compress-ibility (%) | deformation resistance (kgf/mm$^2$) | Remarks |
|---|---|---|---|---|---|---|---|---|---|---|---|---|---|---|
| 42 | 0.55 | 0.02 | 0.37 | 0.010 | 0.010 | 0.08 | 0.26 | 0.0009 | 0.0038 | 60.0 | 2.52 | 65.9 | 78.0 | acceptable example |
| 43 | 0.58 | 0.03 | 0.35 | 0.009 | 0.011 | 0.09 | 0.25 | 0.0014 | 0.0046 | 61.4 | 2.60 | 65.1 | 79.3 | acceptable example |
| 44 | 0.60 | 0.04 | 0.35 | 0.008 | 0.012 | 0.08 | 0.22 | 0.0013 | 0.0048 | 62.5 | 2.63 | 65.0 | 80.4 | acceptable example |
| 45 | 0.48 | 0.03 | 0.55 | 0.009 | 0.008 | 0.09 | 0.35 | 0.0013 | 0.0038 | 57.2 | 2.55 | 68.4 | 88.4 | comparative example |
| 46 | 0.55 | 0.03 | 0.55 | 0.008 | 0.012 | 0.06 | 0.32 | 0.0014 | 0.0044 | 60.0 | 2.73 | 66.8 | 91.2 | comparative example |
| 47 | 0.48 | 0.03 | 0.56 | 0.009 | 0.025 | 0.10 | 0.12 | 0.0015 | 0.0039 | 57.5 | 2.25 | 53.9 | 78.8 | comparative example |
| 48 | 0.55 | 0.02 | 0.56 | 0.010 | 0.026 | 0.11 | 0.12 | 0.0013 | 0.0040 | 60.5 | 2.44 | 50.3 | 81.6 | comparative example |
| 49 | 0.48 | 0.01 | 0.57 | 0.023 | 0.011 | 0.09 | 0.11 | 0.0014 | 0.0048 | 57.3 | 2.23 | 55.4 | 83.5 | comparative example |
| 50 | 0.55 | 0.02 | 0.55 | 0.019 | 0.010 | 0.08 | 0.12 | 0.0015 | 0.0043 | 60.2 | 2.45 | 54.5 | 87.9 | comparative example |
| 51 | 0.48 | 0.02 | 0.57 | 0.009 | 0.010 | 0.10 | 0.12 | 0.0030 | 0.0049 | 57.5 | 2.26 | 55.6 | 81.6 | comparative example |
| 52 | 0.48 | 0.04 | 0.56 | 0.010 | 0.012 | 0.14 | 0.11 | 0.0015 | 0.0095 | 57.3 | 2.25 | 56.8 | 84.6 | comparative example |
| 53 | 0.47 | 0.01 | 0.55 | 0.009 | 0.009 | 0.05 | 0.12 | 0.0012 | 0.0035 | 57.3 | 2.21 | 68.3 | 76.5 | acceptable example |
| 54 | 0.48 | 0.02 | 0.56 | 0.011 | 0.010 | 0.09 | 0.09 | 0.0013 | 0.0042 | 57.9 | 2.20 | 68.5 | 78.1 | acceptable example |
| 55 | 0.49 | 0.01 | 0.55 | 0.012 | 0.011 | 0.11 | 0.11 | 0.0012 | 0.0038 | 58.0 | 2.24 | 68.1 | 78.3 | acceptable example |
| 56 | 0.48 | 0.02 | 0.57 | 0.010 | 0.008 | 0.14 | 0.10 | 0.0016 | 0.0043 | 58.0 | 2.20 | 68.4 | 78.7 | acceptable example |
| 57 | 0.48 | 0.06 | 0.55 | 0.008 | 0.010 | 0.19 | 0.12 | 0.0015 | 0.0035 | 57.8 | 2.10 | 68.6 | 78.9 | comparative example |
| 58 | 0.49 | 0.05 | 0.56 | 0.009 | 0.011 | 0.38 | 0.11 | 0.0014 | 0.0036 | 58.1 | 2.06 | 68.0 | 81.9 | comparative example |
| 59 | 0.48 | 0.04 | 0.55 | 0.010 | 0.009 | 0.45 | 0.12 | 0.0013 | 0.0034 | 57.5 | 1.98 | 68.1 | 82.1 | comparative example |
| 60 | 0.49 | 0.08 | 0.56 | 0.008 | 0.009 | 0.78 | 0.12 | 0.0011 | 0.0039 | 58.2 | 1.95 | 67.9 | 87.1 | comparative example |

The test steel Nos. 1–8 correspond to steels of JIS S40C–S55C. On the other hand, in the test steel Nos. 9–16, the effective hardened depth is approximately equal to that of the steel Nos. 1–8, but the deformation resistance is reduced by about 5–10%.

The test steel Nos. 17–20 and Nos. 57–60 show a case where the amount of Cr added exceeds the upper limit defined in the invention. In this case, as the Cr amount increases, the effective hardened depth lowers and the deformation resistance increases. This indicates that the excessive addition of Cr is harmful for the object of the invention.

The test steel Nos. 21–44 and Nos. 53–56 are acceptable examples using Mo. As seen from these examples, the deformation resistance in cold forging is reduced without degrading induction hardenability by adjusting the amounts of Mo and other alloying elements added.

The test steel Nos. 45 and 46 show a case of excessively adding Mo, which are considerably high in deformation resistance as compared with the test steel Nos. 23 and 26 as an acceptable example.

The test steel Nos. 47–50 show a case where the P or S amount is outside the range defined in the invention, in which the deformability shown by the limiting compressibility considerably lowers. The test steel Nos. 51 and 52 show a case where the O or N amount is outside the range defined in the invention, in which the deformability is degraded and also the deformation resistance increases.

As mentioned above, according to the invention, there can be obtained steel materials having a small deformation resistance and excellent cold forgeability and induction hardenability, so that the invention greatly contributes to industrially and stably manufacturing machine parts having high quality.

What is claimed is:

1. A carbon steel for machine structural use having improved cold forgeability and induction hardenability, consisting essentially of 0.40–14 0.60 wt% of C, not more than 0.05 wt% of Si, 0.30–0.75 wt% of Mn, not more than 0.15 wt% of Cr, 0.005–0.020 wt% of S, not more than 0.015 wt% of P, not more than 0.0020 wt% of O, not more than 0.0080 wt% of N and the balance being substantially Fe.

2. A carbon steel for machine structural use having improved cold forgeability and induction hardenability, consisting essentially of 0.40–0.60 wt% of C, not more than 0.05 wt% of Si, 0.30–0.75 wt% of Mn, not more than 0.15 wt% of Cr, 0.005–0.020 wt% of S, not more than 0.15 wt% of P, not more than 0.0020 wt% of O, not more than 0.0080 wt% of N, 0.05–0.30 wt% of Mo and the balance being substantially Fe.

* * * * *

UNITED STATES PATENT AND TRADEMARK OFFICE

CERTIFICATE OF CORRECTION

PATENT NO. : 4,975,242

DATED : December 4, 1990

INVENTOR(S) : Toshiyuki Hoshino, Nobuhisa Tabata, Isao Machida, Masayoshi Saga, and Takeshi Takagi

It is certified that error appears in the above-identified patent and that said Letters Patent is hereby corrected as shown below:

Cover page, item number 73, delete "Gikan" and substitute --Giken--.

Column 1, line 27, delete "has" (first occurrence).
Column 1, line 46, add --to time-- after "time".
Column 1, line 52, substitute the period after "Cr" with a comma.
Column 1, line 59, delete "is".
Column 2, line 64, delete the comma after "Mo" and substitute --and--.
Column 3, line 22, delete "the".
Column 3, line 27, delete "the".
Column 4, line 3, delete "are necessary to be" and substitute with --must--.
Column 8, line 52, delete "14".

Signed and Sealed this

Twenty-fifth Day of June, 1991

*Attest:*

*Attesting Officer*

HARRY F. MANBECK, JR.

*Commissioner of Patents and Trademarks*